United States Patent [19]

Schmidt

[11] Patent Number: 4,483,099

[45] Date of Patent: Nov. 20, 1984

[54] WINDOW ASSEMBLY

[75] Inventor: Dietrich F. Schmidt, Camp Hill, Pa.

[73] Assignee: Capitol Products Corporation, Mechanicsburg, Pa.

[21] Appl. No.: 597,691

[22] Filed: Apr. 6, 1984

Related U.S. Application Data

[63] Continuation of Ser. No. 338,910, Jan. 12, 1982, , which is a continuation of Ser. No. 113,639, Jan. 21, 1980.

[51] Int. Cl.[3] ..... E05B 65/04

[52] U.S. Cl. ..... 49/63; 49/504

[58] Field of Search ..... 49/62, 63, DIG. 1, DIG. 2, 49/501, 504, 425; 160/90, 91; 52/207

[56] References Cited

U.S. PATENT DOCUMENTS

| | | | |
|---|---|---|---|
| 2,764,235 | 9/1956 | Renton | 49/63 X |
| 3,487,580 | 1/1970 | Holliday | 49/425 X |
| 3,975,881 | 8/1976 | Ninowski, Jr. | 49/501 X |

FOREIGN PATENT DOCUMENTS

| | | | |
|---|---|---|---|
| 1075085 | 4/1980 | Canada | 49/DIG. 1 |

OTHER PUBLICATIONS

Swedish Abstract No. 7714819-5, Published Jun. 30, 1978–Yoshida.

*Primary Examiner*—Kenneth Downey

*Attorney, Agent, or Firm*—Donald L. Johnson; John F. Sieberth; Paul H. Leonard

[57] ABSTRACT

The invention comprises a basic metal window which is so constructed as to receive an interior snap-on plastic window. Exterior metal framing members are provided with tracks or openings which can accommodate various width panels such as single-glazed panels, double-glazed panels, screen panels or other panels as desired. Interior plastic framing members are also provided with suitable tracks for receiving sashes or glass panels. When the interior plastic window is attached to an exterior metal window, an insulated or thermal barrier window construction is provided.

19 Claims, 7 Drawing Figures

WINDOW ASSEMBLY

This application is a continuation of U.S. patent application Ser. No. 338,910, filed Jan. 12, 1982; which application is in turn a continuation of U.S. patent application Ser. No. 113,639, filed on Jan. 21, 1980.

BACKGROUND OF THE INVENTION

1. Field of the Invention

The present invention relates generally to window and similar panel assemblies for installation in a rough opening of an enclosing wall exposed to different temperature conditions at the opposite sides thereof.

The invention particularly relates to a horizontally movable, rolling or sliding window assembly. More particularly, the invention embodies a multi-purpose or combination type of window assembly.

2. Description of the Prior Art

In the construction of buildings and the like, it is usually desirable to provide a window assembly which may be installed as a unit when the building is constructed and which is relatively simple and economical to manufacture and assemble. It is also desirable to provide as many like parts as possible and to secure such parts together with a minimum of fastening devices and labor. It is generally desirable that such window assemblies provide some means for the ready installation and removal of additional panels, such as storm panels and screens.

Generally, in prior art constructions, a window assembly is of a particular fixed type, i.e. single-glazed, double-glazed, thermal, non-thermal, etc. Some window assemblies provide removable storm sashes and/or screen panels. Usually, removal is from the exterior although a few constructions provide for interior removal.

Metal windows or various combinations of metal and plastic windows have a number of advantages over wooden windows. The high thermal conductivity of metals, such as aluminum, is probably the most undesirable property limiting their substitution for wood. To solve the problem of thermal conductivity from exterior exposed surfaces to interior exposed surfaces a wide variety of insulated windows or the like have been constructed. In most of these, the thermal circuit is broken by a plastic member inserted between metal members at the critical locations. A number of these constructions are rather complicated, requiring a number of different plastic and metal parts. U.S. Pat. No. 3,600,857 illustrates one of the more complicated types of insulated windows with movable sash. In such window, the insulating frame member of each sash includes webs defining the respective lateral surface of the sash frame and flanges extending therefrom and having free marginal portions interlocking with the metal sash frame member to space the latter from the web and to cooperate with the web and the metal frame member in defining cavities therebetween.

U.S. Pat. No. 3,302,354 is illustrative of a type of window assembly which provides an exterior frame of extruded members, so formed that header and sill pieces are alike, that jamb pieces are alike. The interior frame is similarly constructed. Once installed, locking strips may be removed so that the interior frame and the glass panels from the exterior frame may be removed from the interior side of the window assembly.

The present invention provides a window system which has a number of advantages over the prior art constructions, including a reduction in components and uniformity of extrusions, glass and other parts.

The instant invention provides a horizontally rolling window system employing a minimum of extruded frame members for fabricating a variety of window combinations. A basic window construction is provided which may be quickly and easily converted to a variety of types of windows either at the plant, at a subsequent location, or even on the job by the ultimate installer.

Other objects and advantages of the invention will be readily apparent from a reading of the description and drawings hereinafter.

SUMMARY OF THE INVENTION

The invention comprises a basic metal window which is so constructed as to receive an interior snap-on plastic window. Exterior metal framing members are provided with tracks or openings which can accommodate various width panels such as single-glazed panels, double-glazed panels, screen panels or other panels as desired. Interior plastic framing members are also provided with suitable tracks for receiving sashes or glass panels. When an interior plastic window is attached to an exterior metal window, an insulated or thermal barrier window construction is provided.

DESCRIPTION OF THE PREFERRED EMBODIMENTS

Figure 7:
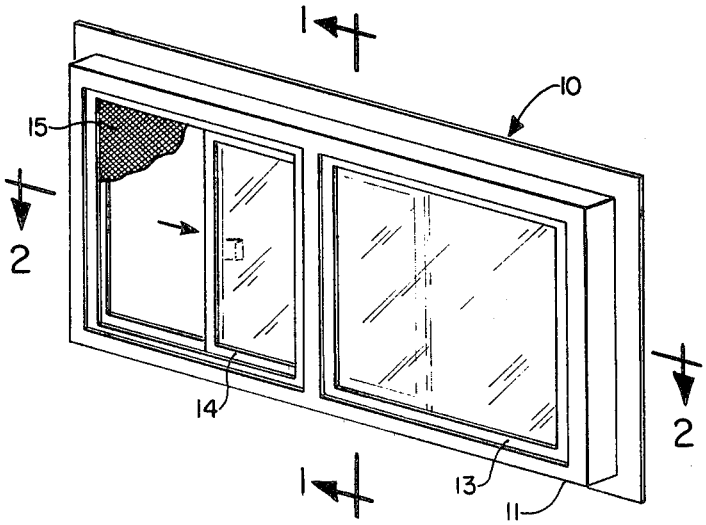
FIG. 7 is a perspective view from the exterior of a window assembly embodying this invention.

Referring to the drawings in detail, and initially to FIG. 7 thereof, a window assembly 10 of the horizontal sliding or rolling type is illustrated. The window 10 comprises an outer metal assembly 11 and a removable or detachable inner plastic assembly 12 (see FIG. 1).

The metal assembly 11 contains a fixed glass panel 13 and a horizontally sliding or movable glass panel 14. Exterior of the panel 14 is a screen panel 15.

Figure 1:
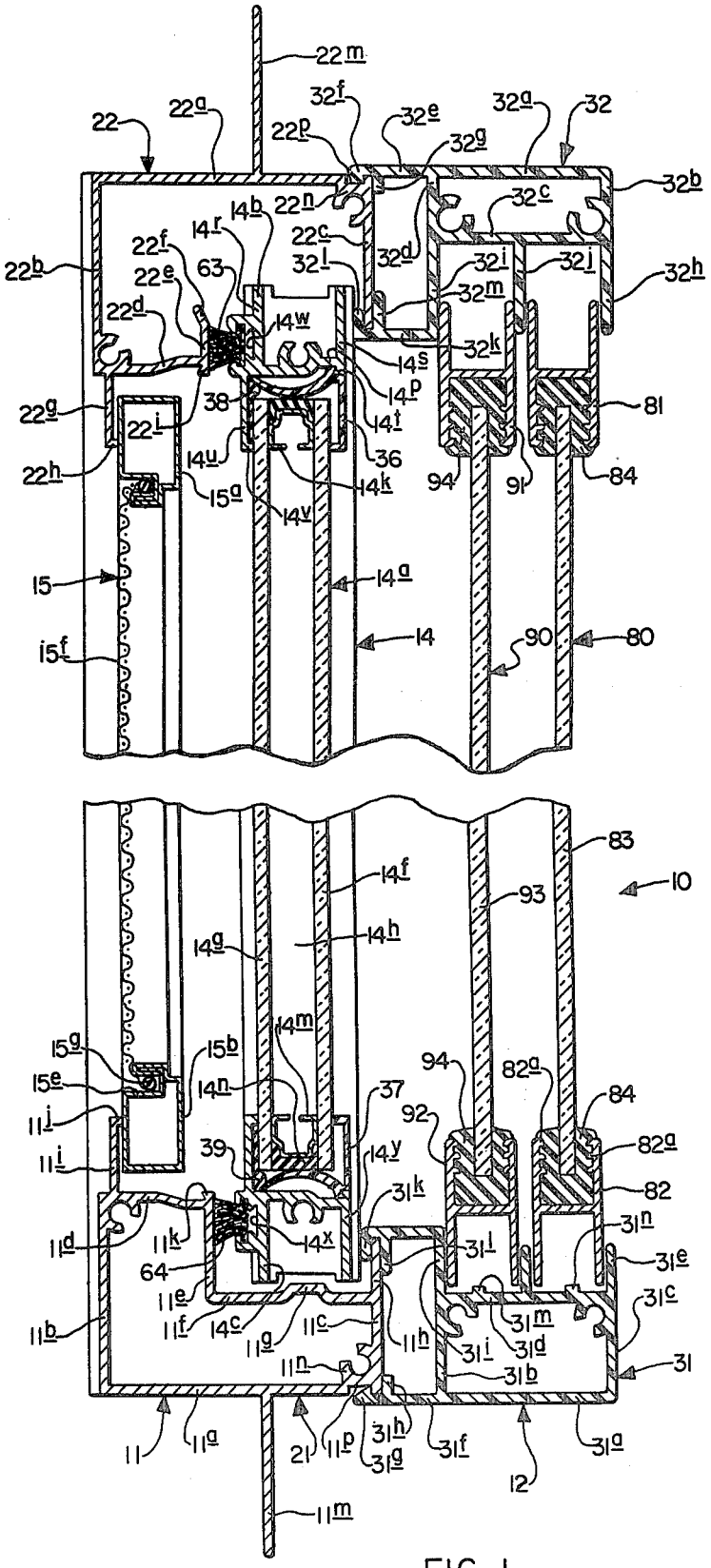
FIG. 1 is an enlarged vertical sectional view taken along the line 1—1 of FIG. 7 illustrating a thermal window embodiment of the invention.
Figure 2:
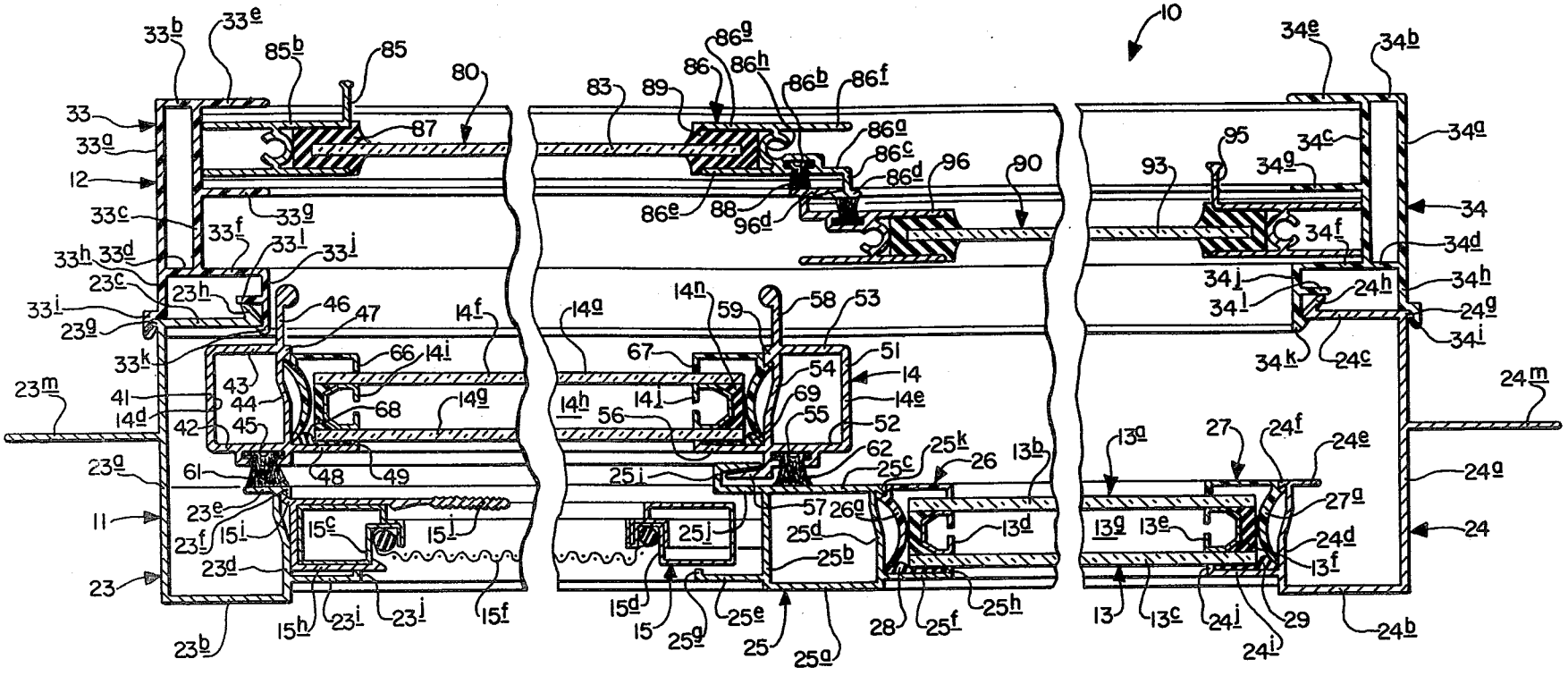
FIG. 2 is an enlarged horizontal sectional view taken along the line 2—2 of FIG. 7.

As can be seen more clearly in FIGS. 1 and 2, the metal assembly 11 includes sill 21, head 22 and side jambs 23 and 24 joined together in the customary manner. The metal framing members 21, 22, 23 and 24 are so constructed that tracks or openings are provided therein for receiving glass, screen or other panels. The glass panels may be single, double or even multi-glazed. Side jambs 23 and 24 are substantially identical.

The metal framing members are preferably aluminum extrusions and along with the panels 13, 14 and 15 provide the basic metal window unit or assembly 11.

The plastic assembly 12 includes sill 31, header 32, and side jambs 33 and 34. The assembly 12 is attached to the interior side of the assembly 11. Sill 31 and header 32 are substantially identical. Side jambs 33 and 34 are also substantially identical.

Framing members 31, 32, 33 and 34 along with sashes or glass panels 80 and 90 are assembled and joined together in a customary manner to provide the interior plastic window assembly 11.

The window assembly 10 as illustrated in FIGS. 1 and 2 is a thermal-break triple-glazed rolling window of the two-panel (2-lite) single vent type with exterior screen panel.

Considering the parts separately, metal sill 21 is a somewhat L-shaped extruded aluminum box or hollow. The sill includes base member 11*a* with end members 11*b* and 11*c* extending at right angles from each end of the member 11. The member 11*d* extends inwardly from the upper end of the member 11*b*. A member 11*e* extends downwardly from one end of the member 11*d* and parallel to the member 11*b*. The member 11*e* is somewhat shorter than the member 11*b*. Member 11*f* extends away from the lower end of the member 11*e* and more or less parallel to base member 11*a* and joins the member 11*c*. The member 11*f* has a somewhat raised U-shaped portion 11*g*. Extending vertically from the member 11*c* is flange 11*h*. Extending upwardly from the member 11*d* and near the end of the member 11*b* is flange 11*i*. Flange 11*i* has a short member 11*j* extending perpendicularly inwardly therefrom. A short member 11*k* extends from the member 11*e* and above the member 11*d*. The member 11*a* has a short member 11*n* formed in one end thereof, with a channel 11*p* therein. Extending downwardly and vertically from base member 11*a* is nailing fin or flange 11*m*.

Metal head or header 22 is also preferably an aluminum extrusion and includes base member 22*a* and members 22*b* and 22*c* extending from each end of the member 22*a* and parallel to each other. The member 22*b* is longer than the member 22*c* and is substantially the same length as the member 11*b*. Extending inwardly from the member 22*b* from one end thereof and parallel to the member 22*a* is member 22*d*. The member 22*d* is similar in shape to the member 11*d*. Flange 22*e* extends inwardly from one end of the member 22*d* and has a short angular member 22*f* extending therefrom. Near one end of the member 22*d* and extending outwardly and vertically therefrom is flange 22*g*. Flange 22*g* has a short member 22*h* extending at right angles from the end thereof. Flange 22*g* is substantially the same as flange 11*i*. Extending outwardly from the member 22*d* and opposite flange 22*e* is short member 22*i*. The member 22 has a channel member 22*n* formed in one end thereof, with a channel 22*p* therein. Extending perpendicularly from base member 22*a* is nailing fin 22*m*.

Metal jamb 23 as seen in FIG. 2, includes base member 23*a* with flanges 23*b* and 23*c* extending at right angles from each end thereof and parallel with each other. A member 23*d* extends at a right angle from the end of the member 23*b*. Flange 23*e* extends from the end of the member 21*d* and is parallel to the member 23*b*. A short member 23*f* also extends at a right angle from the member 23*d* and opposite flange 23*e*. A short member 23*g* extends at a right angle from one end of the base member 23*a* and opposite of member 23*c*. The member 23*c* has a somewhat enlarged foot portion 23*h* on the end thereof. Extending perpendicularly from base member 23*a* is nailing pin 23*m*. A flange 23*i* extends outwardly from the member 23*d* near one end thereof and parallel to the member 23*b*. A short member 23*j* extends at a right angle from the end of the flange 23*i*.

Jamb 24 is substantially identical to jamb 23 and includes base member 24*a*, member 24*b*, member 24*c*, flange 24*d*, member 24*e*, short member 24*f*, short member 24*g*, foot-portion 24*h*, flange 24*i* with short member 24*j* and pin 24*m*.

When the members 21, 22, 23 and 24 are joined together, the pins of each, 21*m*, 22*m*, 23*m* and 24*m* are in the same plane with each other. A center bar 25, also preferably of extruded aluminum, is positioned between jambs 23 and 24 and secured in position perpendicularly between the sill 21 and header 22. Bar 25 is a hollow comprising members 25*a*, 25*b*, 25*c* and 25*d*. Flange 25*e* extends outwardly from member 25*b* near the end thereof and parallel to member 25*a*. Flange 25*f* extends outwardly from member 25*d* near the end thereof and parallel to member 25*a*. Short member 25*g* extends at a right angle from the member 25*e* and short member 25*h* extends at a right angle from the member 25*f*. The members 25*e* and 25*f* are substantially identical. A U-shaped or channel member 25*i* extends outwardly from the end of the member 25*b*. One side 25*j* of the member 25*i* is opposite the member 25*c*. The member 25*d* has a short member 25*k* on the end thereof which extends opposite the member 25*c*.

Fixed sash 13 includes insulated glass panel 13*a* which is positioned in and between center bar 25 and jamb 24 by means of glazing beads 26 and 27 and back bedding sealants 28 and 29, respectively. Glazing beads 26 and 27 are substantially identical and preferably are made of rigid PVC.

Insulated glass panel 13*a* is a typical dual pane panel and includes glass panes 13*b* and 13*c* which are substantially alike and placed opposite and spaced apart from each other by means of spacers 13*d* and 13*e*. A plastic sealant 13*f* extends around the periphery of the glass panels to provide a seal for the dead-air space 13*g* between the panes 13*a* and 13*b*.

Back-bedding sealants 28 and 29 are positioned between insulated glass panel 13*a* and flanges 25*f* and 24*i*, respectively. Glazing beads 26 and 27 are mounted on either side of the panel 13*a* and attached to the center bar 25 and jamb 24, respectively. The spring action of the curved portion 26*a* and 27*a* of the beads 26 and 27, respectively, enables the beads to be locked in place between sealant 28 and short member 25*k* and between sealant 29 and short member 24*f*, respectively.

Insulated glass panel 13*a* is mounted in head 22 and sill 21 similarly as to the mounting in bar 25 and jamb 24. Back-bedding sealants are positioned inside of flanges 22*g* and 11*i* and plastic glazing beads are attached on the members 22*d* and 11*d*. The curved portions of the glazing beads are held in place between the bedding sealants and their respective short members 22*i* and 11*k*.

Screen panel 15 includes top rail 15*a*, bottom rail 15*b*, stile 15*c* and stile 15*d* which are substantially identical to each other. Each of the framing members has a screen receiving channel 15*e* in which screen 15*f* is mounted in a customary way. The screen 15*f* is held in the channels 15*e* by means of a cord or screen bead member 15*g*. The screen panel 15 is of the drop-in type and is positioned between center bar 25 and jamb 23 and between head 22 and sill 11. The panel 15 is held in place by means of a U-shaped member 15*h* mounted on stile 15*c*. The member 15*h* has a short member 15*i* thereon which hooks under the member 23*f*. The member 15*h* also has a handle member 15*j* thereon for enabling removal of the panel 15 from the window assembly 11. Head members 22*h*, 22*g*, 22*d* and 22*i* along with sill members 11*j*, 11*i*, 11*d* and 11*k* form the upper and lower tracks, respectively, for screen panel 15 and also for insulated glass panel 13*a*. Jamb members 23*j*, 23*i*, 23*d* and 23*f* along with center bar members 25*g*, 25*e*, 25*b* and 25*j* form the side tracks for panel 15.

Movable glass panel 14 includes insulated glass 14*a*, top rail 14*b*, bottom rail 14*c*, pull stile 14*d* and interlock stile 14*e*. Insulated glass 14*a* includes glass panes 14*f* and 14*g* spaced apart and opposite each other and joined together in the usual manner with a void space 14*h* between the panes. Spacers 14*i* and 14*j* and 14*k* and 14*m* separate the panes 14*g* and 14*h*. A sealant 14*n* is placed around the periphery of the glass panes 14*g* and 14*h* to completely seal them from each other and provide the dead-air space 14*h*.

Top rail 14*b* is preferably an extruded aluminum member and includes a center member 14*p* with end members 14*r* and 14*s* thereon. A short member 14*t* extends from the member 14*p* and opposite the end member 14*s*. A flange 14*u* extends from the member 14*p* and away from the member 14*r*. A short member 14*v* extends at a right angle from the end of the member 14*w*. A weatherstripping or piling seal channel 14*w* is formed in the by member 14*r*.

Bottom rail 14*c* is substantially identical to top rail 14*b*. For simplification, the parts of bottom rail 14*c* are not numbered individually, but can be considered the same as those of top rail 14*b*.

Glazing beads 36 and 37 and back-bedding sealants 38 and 39 provide the means for mounting the insulated glass 14*a* in top rail 14*b* and bottom rail 14*c*, similarly as to mounting of panel 13*a* in bar 25 and jamb 24.

Pull stile 14*d* and interlock stile 14*e* are also preferably extruded aluminum hollows. Stile 14*d* includes members 41, 42, 43 and 44 which comprise a more or less rectangular hollow. A weather stripping channel 45 is formed in the member 42. A handle or pull member 46 extends from the member 43 and opposite the member 44. A short member 47 extends from the member 44 and opposite the member 43. A flange 48 extends from the member 44 and opposite the member 42. A short member 49 extends at a right angle from the end of the flange 48.

Interlock stile 14*e* is similar to pull stile 14*d* and includes members 51, 52, 53 and 54 which more or less comprise a rectangular hollow. The member 52 has a weather stripping channel 55 formed therein. A flange 56 extends from an end of the member 54 and opposite the member 52. A hooked or L-shaped member 57 extends outwardly from the end of the member 54. Extending from the other end of the member 54 is pull handle 58. Also extending from the member 54 but opposite the member 53 is short member 59.

Insulated glass panel 14*a* is mounted in stiles 14*d* and 14*e* by means of plastic glazing beads 66 and 67 and back-bedding sealants 68 and 69, respectively, similarly to panel 13*a*. The complete glass panel 14 is slidably movable within the frame 11. Panel 14 is guided by members 23*c* and 23*e* on one side and by members 24*c* and 24*e* on the other side. The member 25*c* also provides a guide. Weather stripping members 61 and 62 are inserted in their respective channels 45 and 55. Weather stripping members 63 and 64 are positioned in their respective channels 14*w* and 14*x*. Members 11*e*, 11*f* and 11*h* along with hump portion 11*g* form a guide or lower track for panel 14. Members 22*c* and 22*e* provide a guide or upper track for the panel 14.

When the plastic frame members 31, 32, 33 and 34 are attached to their respective parts of frame 11, short or hooked members 31*a* and 32*a* provide guides on the interior side of the panel 14 and also insulate the panel 14 from the adjacent metal members 11*h* and 22*c*, respectively. When the plastic frame 12 is not attached to the metal frame 11, a plurality of plastic spacer buttons 70 (See FIG. 3) are inserted into suitable openings therefor appropriately located on stiles 14*y* and 14*s* to prevent motal to metal contact of panel 14 with members 11*h* and 22*c*.

As seen in FIGS. 1 and 2, the plastic window or frame assembly 12 includes sill 31, header 32 and jambs 33 and 34. Framing members 31, 32, 33 and 34 are preferably extruded PVC members. They are joined together in a customary or other suitable manner to form the complete plastic assembly 12.

Sill or frame member 31 is a hollow or box-type extrusion and comprises the members 31*a*, 31*b*, 31*c* and 31*d* which form the basic rectangular frame. A flange 31*e* extends from the member 31*c* and opposite thereof. A flange 31*f* extends from the member 31*a* and also opposite thereof. Flange 31*f* has a hooked member 31*g* on the end thereof and a short perpendicular member 31*h* extending intermediately therefrom. A flange 31*i* extends from the member 31*b* and opposite therefrom. A member 31*j* extends at a right angle from the end of the flange 31*i*. Member 31*j* has a hooked or right angle member 31*k* on the end thereof and a perpendicular member 31*l* at an intermediate location therefrom. The members 31*c*, 31*b* and 31*h* are parallel with each other.

Extending perpendicularly from the member 31*d* are a pair of short members 31*m* and 31*n* and a longer center member 31*p*. The members 31*e*, 31*n*, 31*p*, 31*m*, 31*i*, 31*h* and 31*k* are substantially parallel with each other.

Head or header 32 is also a hollow or box-like plastic extrusion. Members 32*a*, 32*b*, 32*c* and 32*d* form the basic rectangular or box-like frame. Flange 32*e* extends from one end of the member 32*a* and has a hooked member 32*f* on the end thereof. A short perpendicular member 32*g* extends from the member 32*e* from an intermediate location thereon and near the hooked member 32*f*. Long flanges 32*h* and 32*i* extend from the ends of the members 32*b* and 32*d*, respectively. A long perpendicular member 32*j* also extends from a central location of the member 32*c*. Flange 32*i* has a member 32*k* extending at a right angle therefrom. A flange or hooked member 32*l* extends from the free end of the member 32*k*. Near the member 32*l*, a short perpendicular member 32*m* extends from the member 32*k*. The members 32*b*, 32*d* and 32*g* are substantially parallel with each other. The members 32*h*, 32*j*, 32*i*, 32*m* and 32*l* are also substantially parallel with each other.

Jamb members 33 and 34 are substantially identical in cross-sectional shape and length. They are spaced apart in the assembly 12 in a mirror image relationship. Jamb 33 is an extruded plastic hollow or box-like frame member. Members 33*a*, 33*b*, 33*c* and 33*d* comprise the basic rectangular frame. A flange 33*e* extends from the member 33*b* and a flange 33*f* extends from the member 33*d*. A perpendicular member 33*g* extends from the member 33*c* at a central location thereon. A flange 33*h* extends from the member 33*a*. A hooked member 33*i* extends from the free end of the flange 33*h*. A member 33*j* extends at a right angle from the flange 33*f* and ends in a hooked portion or member 33*k*. A short perpendicular member 33*l* extends from the member 33*j* at an intermediate location thereon. The members 33*e*, 33*g*, 33*f* and 33*l* are in substantially a parallel relationship with each other. The members 33*b* and 33*d* are also parallel to each other. Members 33*h* and 33*j* are substantially parallel to each other as are members 33*a* and 33*b*.

Members and/or parts 34*a* through 34*l* are identical to their respective lettered parts 33*a* through 33*l*.

A pair of slidably movable single-glazed sash panels 80 and 90 are positioned within the frame 12. For simplicity of construction, the panels 80 and 90 are substantially identical with each other.

Top rails 81 and 91 and bottom rails 82 and 92 are identical members and are preferably aluminum extrusions. Glass panels 83 and 93 are mounted in their respective rails in a customary manner utilizing glazing gaskets 84 and 94.

Rail 82 is a somewhat "H-shaped" extrusion with the members forming the side of the "H" in which the glazing is positioned or mounted having a plurality of short members 82*a* extending inwardly therefrom towards each other for aiding in locking the glazing gasket 84 in position. Sill members 31*p* and 31*e* and head members 32*h* and 32*j* provide a track for panel for rail members 82 and 81, respectively. Sill members 31*p* and 31*i* and head members 32*j* and 32*i* form a track for rail members 92 and 91, respectively.

Plastic sill 31 is attached to metal sill 21 by means of the engagement of member 31*g* with channel member 11*n*. Hooked member 31*g* fits into channel 11*p* with member 31*h* adjacent the interior edge of member 11*c*. The opening formed by members 31*k* and 31*l* is positioned over or on flange 11*h*.

Plastic head 32 is attached to metal head 22 in a somewhat similar manner. Hooked member 32*f* is positioned in channel 22*p* of member 22*n*. Short member 32*g* forms a channel with hook member 32*f* which is positioned over or on one end of the member 22*c*. Members 32*m* and 32*l* form a channel or opening which is fitted on or over the free end of member 22*c*.

Sash 80 also includes a pull stile 85 and an interlock stile 86. Sash 90 similarly includes a pull stile 95 and an interlock stile 96. Pull stiles 85 and 95 are substantially identical. Interlock stiles 86 and 96 are also substantially identical.

Pull stile 85 is somewhat "H-shaped" with a pull handle 85*a* extending at a right angle from one end of one side 85*b* of the "H". Pane 83 is mounted in one side of the "H" and held in place therein by means of a glazing gasket 87.

Interlock stile 86 is also a somewhat "H-shaped" aluminum extrusion. One of the members 86*a* forming the "H" has a weather stripping channel 86*b* therein in which weather stripping 88 is inserted therein. A flange 86*a* extends outwardly at a right angle from the free end of the member 86*b*. A locking foot member 86*d* extends perpendicularly from the flange 86*c*. Foot member 86*d* interlocks with foot member 96*d* of stile 96 when the panels 80 and 90 are in a closed position.

Members 86*e*, 86*f*, 86*g* and 86*h* complete the remainder of the "H" of the stile 86. Glazing panel 83 is inserted in stile 86 between members 86*g* and 86*e* and held in place therein by means of glazing gasket 89.

In the preferred window assembly, interior panels 80 and 90 are slidably movable; however, either or both may be fixed if desired. The construction of the plastic assembly 12 is such that the panels 80 and 90 may be quickly and easily installed or removed.

The present invention provides frame members which are adapted to readily receive various glazing and interior thermal frame members for present or future requirements. FIGS. 3, 4, 5 and 6 illustrate several alternative panel arrangements. In such figures, parts are identified as their like parts were identified in FIGS. 1 and 2.

Figure 3:
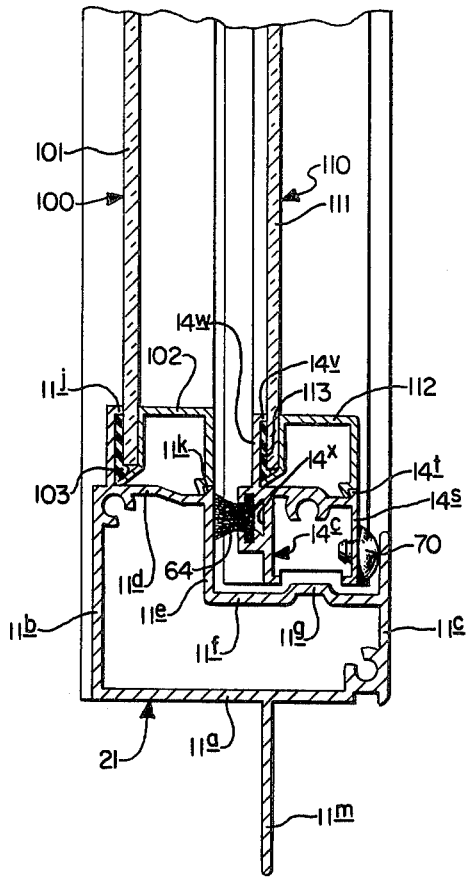
FIG. 3 is an enlarged sectional view of a portion of a basic metal sill member with single-glazed panels.

In FIG. 3, a non-thermal frame utilizing single glazing is illustrated. In this arrangement, sash panels 100 and 110 are identical. Panel 100, for example, includes pane or glass 101 which is mounted in sill 21 utilizing glazing bead 102 and backbedding sealant 103. Sill members 11*i*, 11*j* and 11*k* provide the receiving members for panel 100.

Sash 110 is similarly mounted but is mounted in bottom rail 14*c* in sill 21, which in turn is mounted in sill 21. In this embodiment, glass 111 with glazing bead 112 and back-bedding sealant 113 is mounted or positioned in rail members 14*u*, 14*v* and 14*t*. Member 14*s* has a plurality of spaced apart openings therein for receiving spacer buttons 70. Weather stripping 64 is fixed in channel 14*x* of member.

Sashes 100 and 110 are similarly mounted in head 22. Beads 102 and 112 are identical and are preferably rigid PVC.

Figure 4:
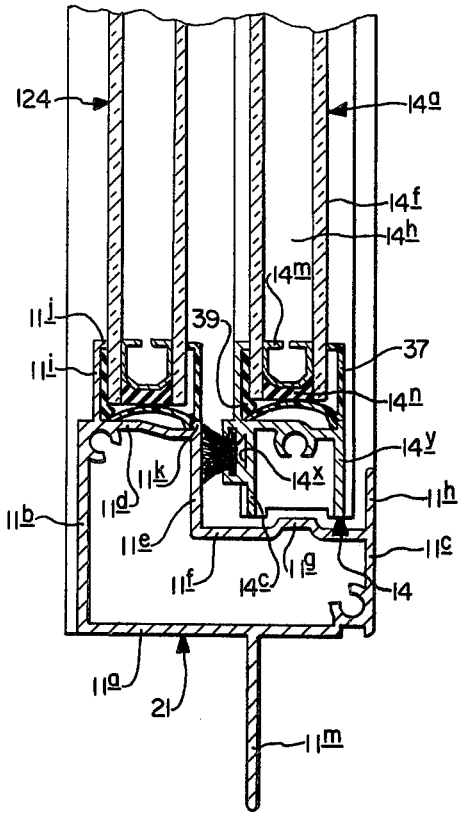
FIG. 4 is an enlarged sectional view of a portion of a basic metal sill member with insulated glass panels.

FIG. 4 is representative of a non-thermal frame with two insulated glass panels 14*a* and 124. Panel 14 and its various parts are the same as those illustrated in FIG. 1 and Panel 14 is mounted in sill 21 the same as is shown in FIG. 1.

Insulated glass panel 124 is positioned in sill 21 in place of screen panel 15. Panel 124 is identical to panel 14*a*. Panel 124 is mounted directly onto sill 21 by means of sill members 11*j*, 11*i* and 11*k*. The mounting of panel 124 on sill 21 is substantially the same as the mounting of panel 14*a* in bottom rail 14*c*. Panels 124 and 14*a* are mounted in head 22 in a similar fashion.

From observing FIGS. 1, 2 and 3, the versatility of the basic metal assembly 11 is readily seen. The same basic sill and head framing members are quickly and easily fitted with either dual or insulated glass panels, single glass panels or screen panels. The panels may also be either fixed or movable as desired.

Figure 5:
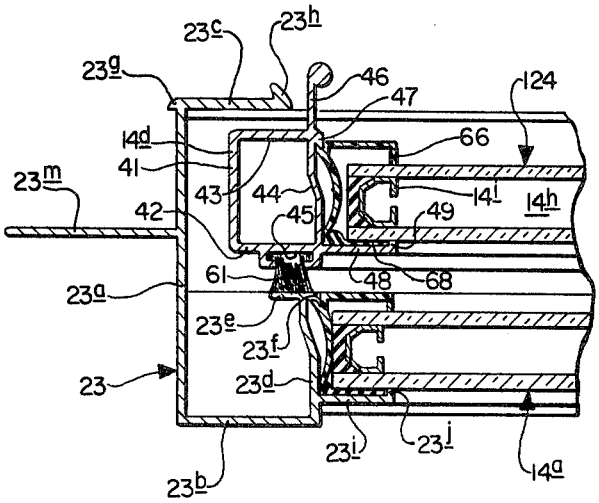
FIG. 5 is an enlarged sectional view of a portion of a basic metal jamb member with insulated glass panels.
Figure 6:
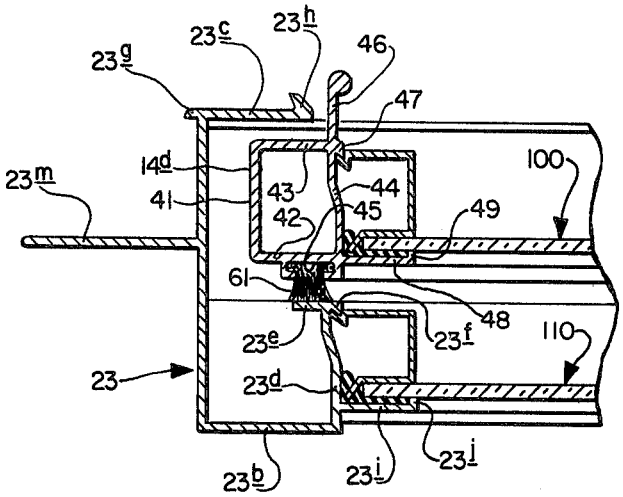
FIG. 6 is an enlarged sectional view of a portion of a basic metal jamb member with single-glazed panels.

FIGS. 5 and 6 illustrate non-thermal frames with insulated glass and single glass, respectively. The mounting of insulated glass panels 14*a* and 124 in jamb 23 is shown in FIG. 5. The mounting of single glass panels 100 and 110 is shown in FIG. 6.

The metal parts of the jamb members 23 and 24 are so constructed that the glass panels are mounted therein in substantially the same way as they are mounted in their respective sill and head members.

The plastic assembly 12 of FIGS. 1 and 2 may be attached to any of the embodiments illustrated in FIGS. 3–6.

The novel construction of this invention provides basic metal framing members and basic plastic framing and other members which can be quickly and easily assembled to provide a variety of types of window assemblies as required or desired. For example, windows may be standard frames with either single glazing or insulated glazing; they may be thermal break windows with triple or double glazing and with inside thermal sashes; they may also be singles, side vent or center vent.

It can readily be appreciated that this novel window assembly is a multi-purpose one which is readily adapted to the particular needs of the installer and the climatic conditions to be met.

The foregoing disclosure and description of the invention is illustrative and explanatory thereof and various changes in the size, shape and materials, as well as in the details of the illustrated construction may be made within the scope of the appended claims without departing from the spirit of the invention.

What is claimed is:

1. A basic metal window assembly complete in and of itself and so constructed as to receive without alteration of the assembly an interior snap-on plastic window, said metal window assembly comprising a basic or outer metal frame to be installed in a rough opening in an enclosing wall, said basic metal frame including a metal sill, a metal head and a pair of metal jambs; attachment means on each of said sill, said head and said jambs for enabling the metal frame to be attached to the enclosing wall; an exterior and interior spaced apart track means in each of said sill, head and jambs for receiving a panel in each of said track means; each of said track means being so constructed as to be able to receive panels of various thicknesses without alteration of the track means; a panel in each of said track means in a lapping relationship; at least one of said panels being horizontally movable; and substantially unobtrusive flange means on each of said sill, head and jambs for receiving attaching means of a plastic frame of said interior snap-on plastic window on the interior side thereof, said flange means being substantially the same plane as said panels in said window assembly.

2. The window assembly of claim 1, wherein at least one of said panels is an insulated glass panel.

3. The window assembly of claim 1, wherein the exterior track means includes at least two panels, and one of said panels is a glass panel and the other of said panels is a screen panel.

4. The window assembly of claim 3, wherein the exterior glass panel and the exterior screen panel are in substantially the same plane with each other and separated by a center bar and each of said exterior panels being in a fixed position.

5. The window assembly of claim 4, wherein said exterior glass panel is a single glazed glass panel.

6. The window assembly of claim 4 wherein said exterior glass panel is an insulated glass panel.

7. The window assembly of claim 3, wherein the interior track means includes a horizontally slidably movable glass panel.

8. The window assembly of claim 7, wherein the interior glass panel is a single-glazed glass panel.

9. The window assembly of claim 7, wherein the interior glass panel is an insulated glass panel.

10. The window assembly of claim 4, wherein the interior track means includes a horizontally slidably movable glass panel, said center bar including an interlock means on the interior side thereof which interlocks with an interlock stile on said interior movable panel and an interlock stile on the exterior side of said movable panel for interlocking with the interlock means on said center bar.

11. The window assembly of claim 1, wherein said exterior track means includes at least one fixed panel and said interior track means includes a horizontally slidably movable panel, a center bar vertically positioned in said exterior track means, panel receiving means on said center bar, glazing means on the periphery of said exterior panel attaching said exterior panel to each said sill track means, said head track means, said jamb track means and said panel including a top rail, a bottom rail, a pull stile and an interlock stile; glazing means on the periphery of said interior panel attaching said interior panel to each said top rail, said bottom rail, said pull stile and said interlock stile; said top rail positioned in said interior head track means and said bottom rail positioned in said interior sill track means, so said panel slides therein and said pull stile and said interlock stiles positioned in said jamb track means so that said panel is positioned in one jamb track means when in a closed position and in the other jamb track means when in an open position.

12. A metal frame complete in and of itself and constructed so as to receive and interior snap-on plastic window comprising a metal sill, a metal head and a pair of metal jambs, track means on said head for receiving an exterior panel, track means on said head for receiving an interior panel, track means on said sill for receiving an exterior panel and track means on said sill for receiving an interior panel, said exterior head panel receiving track means and said exterior sill panel receiving track means being substantially identical with each other; each said exterior and said interior track panel receiving means being of a width sufficiently great that they can each receive an insulated glass panel without alteration of said track panel receiving means; and substantially unobtrusive flange means on said head, sill and jambs for receiving attaching means of a plastic window frame on the interior side of said window frame, said flange means being in substantially the same plane as said panels in said window frame.

13. The window frame of claim 12 and a plastic frame attached to the interior side of side window frame; a plurality of sashes or panels in each of said frames to thereby form a complete thermal break window assembly; the relationship of said plastic frame to said metal window frame being such that when installed in an opening in an enclosed wall, complete separation of exterior metal members from interior metal members is provided.

14. The window frame of claim 13, including a glass panel in said exterior panel receiving track means, a slidably movable horizontally glass panel in said interior panel receiving track means; a center bar in said exterior track means and attachment means for adjoining said exterior glass panel to said center bar.

15. A thermal break window assembly, comprising a basic metal window frame including head, sill and jambs; each of said metal head, sill and jambs having panel receiving track means thereon for receiving an interior glass panel and an exterior glass panel; each of said panel receiving track means being so constructed as to receive panels of various thicknesses without alteration of the panel receiving track means; an interior glass panel in said metal interior panel receiving track means and an exterior glass panel in said metal exterior panel receiving track means, and substantially unobtrusive flange means on each of said metal head, sill and jambs for receiving attaching means of a basic plastic window frame to the interior side of said metal window frame; said flange means being in substantially the same plane as said interior and exterior glass panels in said window assembly; a basic plastic window frame including head, sill and jambs, each of said plastic head, sill and jambs having panel receiving track means thereon for receiving an interior glass panel in said plastic interior panel receiving track means and an exterior glass panel in said plastic exterior panel receiving track means, and hook means on each of said plastic head, sill and jambs for attaching said basic plastic window frame to said flange means on said basic metal window frame on the interior side thereof; and the relationship of said metal window frame to said plastic window frame being such that when joined together and installed in a suitable opening in an enclosing wall, a complete thermal break window assembly is provided.

16. The window assembly of claim 15, wherein at least one of the glass panels in the metal frame is an insulated glass panel.

17. The window assembly of claim 15, wherein the metal exterior panel receiving track means includes a fixed insulated glass panel and a fixed screen panel adjacent thereto in a side by side relationship.

18. The window assembly of claim 17, wherein the metal interior panel receiving track means includes a slidably movable horizontally insulated glass panel.

19. The window assembly of claim 15, wherein said interior glass panel in said plastic interior panel receiving track means and said exterior glass panel in said plastic exterior panel receiving track means are substantially identical with each other and each are slidably movable horizontally.

* * * * *

UNITED STATES PATENT AND TRADEMARK OFFICE

CERTIFICATE OF CORRECTION

PATENT NO. : 4,483,099

DATED : November 20, 1984

INVENTOR(S) : Dietrich F. Schmidt

It is certified that error appears in the above-identified patent and that said Letters Patent is hereby corrected as shown below:

Column 4, Line 10, reads all one paragraph and should have paragraph break at end of sentence.

Column 6, Line 12, reads "motal" and should read -- metal --.

Column 10, Line 2, reads "said panel including a top rail," and should read -- said panel receiving means on said center bar; said movable panel including a top rail, --.

Signed and Sealed this

*Thirtieth* Day of *April 1985*

[SEAL]

*Attest:*

DONALD J. QUIGG

*Attesting Officer* *Acting Commissioner of Patents and Trademarks*